US012704068B2

(12) United States Patent
Berger

(10) Patent No.: US 12,704,068 B2
(45) Date of Patent: Aug. 11, 2026

(54) VACUUM ENGINE

(71) Applicant: Energie-Innovation AG, Pfäffikon (CH)

(72) Inventor: Franz Berger, Zurich (CH)

(73) Assignee: Energie-Innovation AG, Pfäffikon (CH)

( * ) Notice: Subject to any disclaimer, the term of this patent is extended or adjusted under 35 U.S.C. 154(b) by 0 days.

(21) Appl. No.: 18/833,527

(22) PCT Filed: Jan. 30, 2023

(86) PCT No.: PCT/EP2023/052191
§ 371 (c)(1),
(2) Date: Jul. 26, 2024

(87) PCT Pub. No.: WO2023/148126
PCT Pub. Date: Aug. 10, 2023

(65) Prior Publication Data

US 2025/0122804 A1 Apr. 17, 2025

(30) Foreign Application Priority Data

Feb. 1, 2022 (EP) ..... 22154647

(51) Int. Cl.
*F01B 29/02* (2006.01)
*F01B 23/08* (2006.01)
*F01B 25/10* (2006.01)

(52) U.S. Cl.
CPC ..... *F01B 29/02* (2013.01); *F01B 23/08* (2013.01); *F01B 25/10* (2013.01)

(58) Field of Classification Search
CPC ..... F01B 29/02; F01B 29/00
See application file for complete search history.

(56) References Cited

U.S. PATENT DOCUMENTS 3,018,944 A * 1/1962 Zaphiropoulos ..... H01J 41/20 417/49
3,700,359 A 10/1972 Vanderjagt
(Continued)

FOREIGN PATENT DOCUMENTS

CN 102797506 A 11/2012
CN 102865106 A 1/2013
(Continued)

OTHER PUBLICATIONS

Machine Translation of EP2910270.*
(Continued)

*Primary Examiner* — Nathaniel E Wiehe
*Assistant Examiner* — Daniel S Collins
(74) *Attorney, Agent, or Firm* — Lerner David LLP

(57) ABSTRACT

An arrangement includes a combustion-free reciprocating engine having a cylinder closed by a cylinder head and a negative pressure chamber.
A piston is coupled to a crankshaft via a connecting rod. The connecting rod and the crankshaft are integrated in a crankcase of the reciprocating engine.
The cylinder head has an inlet valve and an outlet valve. The vacuum chamber is connectable to a working chamber of the cylinder via the outlet valve, to generate a negative pressure in the working chamber, and to the atmosphere (A) surrounding the reciprocating engine via the inlet valve to generate ambient pressure in the working chamber.
A valve control controls the intake and the exhaust valves such that the piston is moved back and forth by alternately applying ambient pressure and negative pressure
There is always a substantially constant pressure, in a region of the piston facing away from the cylinder head.

16 Claims, 2 Drawing Sheets

(56) References Cited

U.S. PATENT DOCUMENTS

| | | | | | |
|---|---|---|---|---|---|
| 4,476,306 | A * | 10/1984 | Peeters | ..... | C07D 239/56<br>544/309 |
| 2020/0072215 | A1 * | 3/2020 | Oberbeck | ..... | C08F 214/262 |
| 2025/0122804 | A1 | 4/2025 | Berger | | |

FOREIGN PATENT DOCUMENTS

| | | | | | |
|---|---|---|---|---|---|
| CN | 205677674 | * | 6/2016 | ..... | F01B 29/02 |
| CN | 105888729 | A | 8/2016 | | |
| CN | 113830049 | A | 12/2021 | | |
| DE | 20118521 | U1 | 4/2002 | | |
| DE | 202010015561 | U1 | 1/2011 | | |
| EP | 2910270 | B1 * | 8/2017 | ..... | A61M 11/02 |
| EP | 3249155 | A1 * | 11/2017 | ..... | F01B 29/02 |
| EP | 4219895 | A1 | 8/2023 | | |
| FR | 2434925 | A1 | 3/1980 | | |
| FR | 2884281 | A1 * | 10/2006 | ..... | F01B 29/02 |
| FR | 3051855 | B1 | 1/2020 | | |
| JP | 2009275633 | A | 11/2009 | | |
| WO | 2023148126 | A1 | 8/2023 | | |

OTHER PUBLICATIONS

Machine Translation of FR2884281.*
International Search Report for Application No. PCT/EP2023/052191 mailed Apr. 6, 2023. 2 pages.

* cited by examiner

VACUUM ENGINE

CROSS-REFERENCE TO RELATED APPLICATIONS

The present application is a national phase entry under 35 U.S.C. § 371 of International Application No. PCT/EP2023/052191, filed Jan. 30, 2023, published in German, which claims priority to EP Application Serial No. 22154647.6, filed Feb. 1, 2022, the disclosures of which are incorporated herein by reference in their entireties.

TECHNICAL FIELD

The invention relates to an arrangement comprising a reciprocating engine designed for combustion-free operation and a vacuum chamber in which a reduced air pressure can be generated relative to the atmosphere surrounding the reciprocating piston engine. The invention further relates to a method of operating such an arrangement and to the use of the arrangement for driving a mechanical machine and/or for generating electric power.

PRIOR ART

In the field of energy technology, solutions are constantly being sought for the most efficient, safe, environmentally friendly and economical generation, conversion, storage and use of energy in various forms. Today, the focus is strongly on solutions that are based on renewable energies or make them usable.

In this context, among other things, power engines are known which perform mechanical work by using negative pressure. EP 3 249 155 A1 (Benkendil), for example, describes an air motor that does not convert heat into mechanical work like a conventional heat engine, but works by the effect of negative pressure. A cylinder is used which is closed at both ends and divided into two chambers inside by a movable piston. Each of the two chambers is provided with an inlet valve and an outlet valve, and each chamber can be connected to a vacuum generator via its outlet valve and to the ambient air via its inlet valve. When the outlet valve of one chamber is open, the inlet valve of that chamber is closed, while in the other chamber the inlet valve is open and the outlet valve is closed. By alternately opening and closing the valves, the piston can be moved back and forth in the cylinder.

Via a push rod attached to the piston and extending out of the cylinder, its translational motion can be converted into a rotational motion by means of an appropriate mechanism, so that a generator can be operated, for example.

To generate the required negative pressure, EP 3 249 155 A1 (Benkendil) proposes a venturi tube that is inserted into a water stream, for example. For example, the venturi tube can be placed in a watercourse, in the area of a weir or at the outlet of a dam.

However, it has been shown that the power machines known so far, which perform mechanical work by using negative pressure, are not completely convincing. In particular, the efficiency of known machines is relatively low and there are problems in terms of design. There is therefore still a need for improved solutions.

SUMMARY OF THE INVENTION

It is therefore the object of the invention to provide improved solutions, which make it possible to use negative pressure as a form of energy. In particular, devices are to be provided on the basis of power machines, which perform mechanical work by using negative pressure, which in turn can be converted into other forms of energy as required.

Accordingly, the core of the invention is an arrangement comprising a reciprocating piston engine, which is designed for combustion-free operation, and a vacuum chamber, in which a reduced air pressure can be generated relative to the atmosphere surrounding the reciprocating piston engine, wherein:

a) the reciprocating piston engine has at least one cylinder which is closed by a cylinder head and in which a piston is movable and wherein the piston is coupled to a crankshaft of the reciprocating piston engine via a connecting rod on the side facing away from the cylinder head, wherein the connecting rod and the crankshaft are integrated in a crankcase of the reciprocating piston engine;

b) the at least one cylinder on the cylinder head has at least one inlet valve and at least one separate outlet valve, wherein the vacuum chamber can be connected to the working chamber of the at least one cylinder in a fluid-conducting manner via the outlet valve in order to generate a vacuum in the working chamber and the working chamber can be connected to the atmosphere surrounding the reciprocating piston engine in a fluid-conducting manner via the inlet valve in order to generate ambient pressure in the working chamber;

c) wherein a valve control is provided which controls the inlet valve and the outlet valve in operation such that the piston in the at least one cylinder is moved back and forth by alternately applying ambient pressure and negative pressure;

d) and the reciprocating piston engine is designed in such a way that, during operation, there is always a substantially constant pressure, in particular an atmospheric pressure surrounding the reciprocating piston engine, in a region of the piston facing away from the cylinder head The arrangement according to the invention has proved to be extremely advantageous and efficient. Without being bound by theory, it is assumed that due to the essentially constant pressure on the side of the piston facing away from the cylinder head, a rounder movement of the piston is achieved compared with approaches such as those described in EP 3 249 155 A1.

In the present case, a substantially constant pressure means in particular that during operation the pressure in the area of the piston facing away from the cylinder head does not change by more than 50 mbar, in particular by no more than 10 mbar.

In addition, no sealing of the push rod or connecting rod is required when it is guided out of the cylinder. Such seals are usually costly to implement and exhibit relatively high leakage rates. Overall, therefore, higher speeds can be realized without excessive mechanical stresses, and the interplay between vacuum and atmospheric pressure in the working chamber can be controlled more precisely.

Due to the additional integration of the connecting rod and the crankshaft in the crankcase, the moving parts of the reciprocating piston engine are optimally protected against damage and the effects of the weather, and the pressure ratio in this area can be controlled in the best possible way.

It is also important to note that the inlet valve and outlet valve are two separate valves, with the outlet valve designed exclusively to exhaust air from the working chamber, while the inlet valve is designed exclusively to supply air to the working chamber. This separation provides extremely precise control of the air supply and exhaust. If the air supply and the air removal take place via the same inlet or outlet, the efficiency decreases considerably.

The use of a vacuum chamber in the arrangement according to the invention further ensures a substantially constant vacuum during operation of the reciprocating piston engine, and this over a wide range irrespective of the speed. This cannot be achieved by simply extracting the air from the working chamber with a fan or the like.

In particular, the vacuum chamber has a volume that is larger than the displacement of the reciprocating piston engine. In particular, the volume of the vacuum chamber corresponds to at least ten times, in particular at least one hundred times, in particular at least one thousand times, the displacement of the reciprocating piston engine. The displacement of the reciprocating piston engine defines the volume displaced by the stroke of all pistons in total.

The functional interaction of the elements of the arrangement according to the invention enables a surprisingly advantageous and efficient use of negative pressure and conversion into mechanical work. In other words, the individual elements of the arrangement according to the invention work together synergistically.

A further advantage is that reciprocating piston engines used according to the invention can be realized by converting conventional internal combustion engines, e.g. gasoline engines or diesel engines. Depending on the engine type, it is sufficient, for example, to adapt the valve control so that the engine can be operated with negative pressure. Thus, the arrangement according to the invention can be realized in a relatively simple and inexpensive manner. According to an advantageous embodiment, the reciprocating piston engine is therefore an internal combustion engine with modified valve control.

In a preferred embodiment, the reciprocating piston engine has at least two cylinders, in particular four, five, six, eight, ten or twelve cylinders. In this way, the advantages of the invention come to bear to a particular extent. In principle, however, it is also possible to provide a reciprocating piston engine with a single cylinder.

In particular, the reciprocating piston engine is a V-engine, a radial engine or an in-line engine. However, other engine geometries are also possible.

The valve control is implemented in particular via at least one, for example two, camshaft(s) and/or cam disc(s) coupled to the crankshaft. The crankshaft is coupled in particular purely mechanically to the at least one camshaft and/or cam disk. The inlet and outlet valves are preferably opened and closed via tappets, cam followers and/or rocker arms interacting with the at least one camshaft and/or cam disk. This enables particularly precise and fast opening and closing of the valves, which is especially advantageous for operation of the reciprocating piston engine with vacuum. The coupling is implemented in particular via a control chain or a toothed belt.

In principle, however, the valve control can also be implemented differently. According to another possible embodiment, the valve control is a pneumatic, hydraulic and/or electromechanical valve control.

In particular, the at least one camshaft and/or cam disk is coupled to the crankshaft with a gear ratio of 2:1, so that in operation the at least one camshaft and/or cam disk has half the speed of the crankshaft. This allows the valves to be opened and closed precisely. However, other gear ratios can also be implemented.

According to a further preferred embodiment, an engine block, the piston, the connecting rod, the crankshaft, the at least one camshaft and/or the crankcase of the reciprocating piston engine, in particular the entire mechanical structure of the reciprocating piston engine, are made of plastic, ceramic and/or a composite material. Depending on the material used, this can reduce the weight of the reciprocating piston engine, simplify its manufacture and/or reduce the cost of its manufacture and spare parts. Since little frictional heat is generated during operation of the reciprocating piston engine, the reciprocating piston engine hardly heats up. No cooling is required. It is therefore possible to manufacture the engine or components thereof from less heat-resistant and less expensive materials than conventional internal combustion engines. Another advantage of the aforementioned materials is that they can be manufactured, for example, using additive manufacturing processes such as 3D printing with virtually any shape and structure, so that specially designed engine shapes can also be realized.

According to another advantageous embodiment, the engine block, the piston, the connecting rod, the crankshaft, the at least one camshaft and/or the crankcase of the reciprocating piston engine, in particular the entire mechanical structure of the reciprocating piston engine, are made of metal. In this way, particularly robust reciprocating piston engines can be realized.

The valve control is designed in particular in such a way that when the maximum stroke height of the piston in the at least one cylinder is reached, the outlet valve is opened and the inlet valve is closed, so that the air pressure in the working chamber is reduced, and when the minimum stroke height of the piston in the at least one cylinder is reached, the inlet valve is opened, so that the air pressure in the working chamber is increased. This takes place in particular in uniform cycles during operation of the reciprocating piston engine.

The maximum stroke height of the piston is reached when the working space in the cylinder has the maximum volume, while the minimum stroke height of the piston is reached when the working space in the cylinder has the minimum volume.

According to a particularly preferred embodiment, the valve control is designed in such a way that:

- in a first stroke in which the piston moves towards the cylinder head, the outlet valve is open and the inlet valve is closed, so that the piston is pulled towards the cylinder head by the negative pressure;
- in a subsequent second stroke, in which the piston moves away from the cylinder head, the outlet valve is closed and the inlet valve is open in a first time period, and in a subsequent second time period both valves are closed, so that in the second time period the piston moving away from the cylinder head generates a vacuum in the working chamber.

A stroke is understood to be a complete movement of the piston from one dead center to the other. In particular, one stroke occurs during a half revolution of the crankshaft. Both strokes together occur during one complete revolution of the crankshaft.

The first time period and the second time period in the second stroke correspond in particular to 40-60% each, in particular to 50% each, of the duration of the entire second stroke. In particular, the first and second time periods thus each correspond to a half stroke.

The two strokes are executed one after the other during operation, in particular in a continuous process.

The valve controls described above have been found to be particularly preferred.

In the case of more than one cylinder, the crankshaft and the valve control system are designed in such a way that the pistons in the respective cylinders are moved at least partially out of phase during operation. This is analogous to conventional internal combustion engines.

The vacuum chamber is connected in particular in a fluid-conducting manner to a vacuum generating device, in particular a vacuum pump, so that the vacuum chamber can be or is evacuated vibration-free by the vacuum generating device. The arrangement according to the invention can be operated by completely different vacuum generating devices and can thus be used extremely flexibly.

According to one embodiment, the vacuum generating device includes a venturi tube. A venturi tube can be used as a pump, which is simple in design and has no moving parts. Accordingly, venturi tubes are robust, low-maintenance and versatile. According to one possible embodiment, the venturi tube is installed in a watercourse, e.g. in the area of a weir or at the outlet of a dam. Thus, with the arrangement according to the invention, water power can be converted into mechanical energy and, if required, further into electrical energy, e.g. via a generator.

According to a further advantageous embodiment, the vacuum generation device comprises an electrically operated vacuum pump, in particular a rotary vane pump. The electrically operated vacuum pump can be present as an additional or sole vacuum generation device. This makes it possible, for example, to compensate for fluctuations in other vacuum generation equipment. Likewise, with an electrically operated vacuum pump, the arrangement according to the invention can be operated entirely by electrical energy, e.g. by solar energy or surplus energy from the electricity grid.

However, other vacuum generation devices are also conceivable, such as mechanically operated pumps, which can be driven by wind energy, for example.

According to a further preferred embodiment, the vacuum generation device includes, in addition to the electrically operated vacuum pump, a vacuum booster which is connected between the vacuum chamber and the electrically operated vacuum pump. In particular, the vacuum booster is electrically operated.

Vacuum boosters increase the pumping speed and ultimate pressure of vacuum pumps. They increase the performance of vacuum systems by a factor of up to ten. Vacuum boosters work according to the Roots principle: Two Roots pistons rotate synchronously inside a housing. These do not touch each other or the housing. This means that no lubricants or operating fluids are required in the process chamber. During the rotation of the Roots pistons, gas is transported between the Roots pistons and the housing into the downstream vacuum pump.

In operation, the pressure in the vacuum chamber is preferably at least 0.2 bar, in particular at least 0.4 bar, in particular at least 0.7 bar, lower than the atmospheric pressure surrounding the reciprocating piston engine. In particular, the pressure in the vacuum chamber is in the range of 0.05-0.8 bar, especially 0.1-0.5 bar, in particular 0.1-0.3 bar. At such pressures, the arrangement according to the invention works particularly effectively. In special constellations, however, other pressure ratios are also possible.

It is further preferred if the reciprocating piston engine has a turbocharger, the turbocharger being driven by the air flowing out of the outlet valve and compressing the ambient air supplied via the inlet valve. A turbocharger consists of a turbine that harnesses the energy of the expelled air and drives a compressor that compresses the ambient air supplied. The air supply is thus increased to achieve faster volume filling.

It is also advantageous if the crankcase has a crankcase ventilation, in particular an open crankcase ventilation. This is designed in such a way that the inner volume of the crankcase and/or the area of the piston facing away from the cylinder head communicates with the surrounding atmosphere in a fluid-conducting manner. This makes it possible to maintain a substantially constant pressure on the area of the piston facing away from the cylinder head in a simple manner, while at the same time protecting the connecting rod and crankshaft from external influences.

In a further preferred embodiment, the crankshaft of the reciprocating piston engine is coupled to an electricity generator so that electricity can be or is generated by the work of the reciprocating piston engine. The electricity can be used, for example, to operate external loads and/or can be temporarily stored in an electricity storage unit.

Another aspect of the present invention relates to a method of operating an arrangement as described above, wherein negative pressure and ambient pressure are alternately applied across the inlet valve and the outlet valve in the working chamber so as to move the piston back and forth in the at least one cylinder so as to drive the crankshaft.

In particular, when the maximum stroke height of the piston in the at least one cylinder is reached, the outlet valve is opened and the inlet valve is closed, so that the air pressure in the working chamber is reduced, and when the minimum stroke height of the piston in the at least one cylinder is reached, the outlet valve is closed and the inlet valve is opened, so that the air pressure in the working chamber is increased.

Preferably, the valves are controlled by the valve control system in such a way that:

- in a first stroke in which the piston moves towards the cylinder head, the outlet valve is open and the inlet valve is closed, so that the piston is pulled towards the cylinder head by the vacuum;
- in a subsequent second stroke, in which the piston moves away from the cylinder head, in a first time period the outlet valve is closed and the inlet valve is open and in a subsequent second time period both valves are closed, so that in the second time period the piston moving away from the cylinder head generates a negative pressure in the working chamber.

Both strokes together occur during one complete revolution of the crankshaft.

The two strokes are executed one after the other during operation, in particular in a continuous process.

The vacuum chamber is evacuated in operation, in particular continuously, by a fluid-conducting connected vacuum generating device, in particular a vacuum pump. Possible vacuum generation devices are described above.

In operation, the pressure in the vacuum chamber is preferably maintained at at least 0.2 bar, in particular at least 0.4 bar, in particular at least 0.7 bar, below the atmospheric pressure surrounding the reciprocating piston engine. In particular, the pressure in the vacuum chamber is maintained in the range of 0.05-0.8 bar, especially 0.1-0.5 bar, in particular 0.1-0.3 bar.

Preferably, the air flowing out of the outlet valve is used to drive a turbocharger, which compresses the ambient air before it is fed in via the inlet valve. This further improves efficiency.

It is also advantageous if the crankcase is vented during operation via a crankcase vent, in particular an open crankcase vent.

An additional aspect of the present invention relates to the use of an arrangement as described above for driving a mechanical machine and/or generating electrical power.

Further advantageous embodiments and combinations of features of the invention result from the following detailed description and the totality of the patent claims.

BRIEF DESCRIPTION OF THE DRAWINGS

The drawings used to explain the embodiment show.

In principle, the same parts are provided with the same reference signs in the figures.

Ways to Carry Out the Invention

Figure 1:
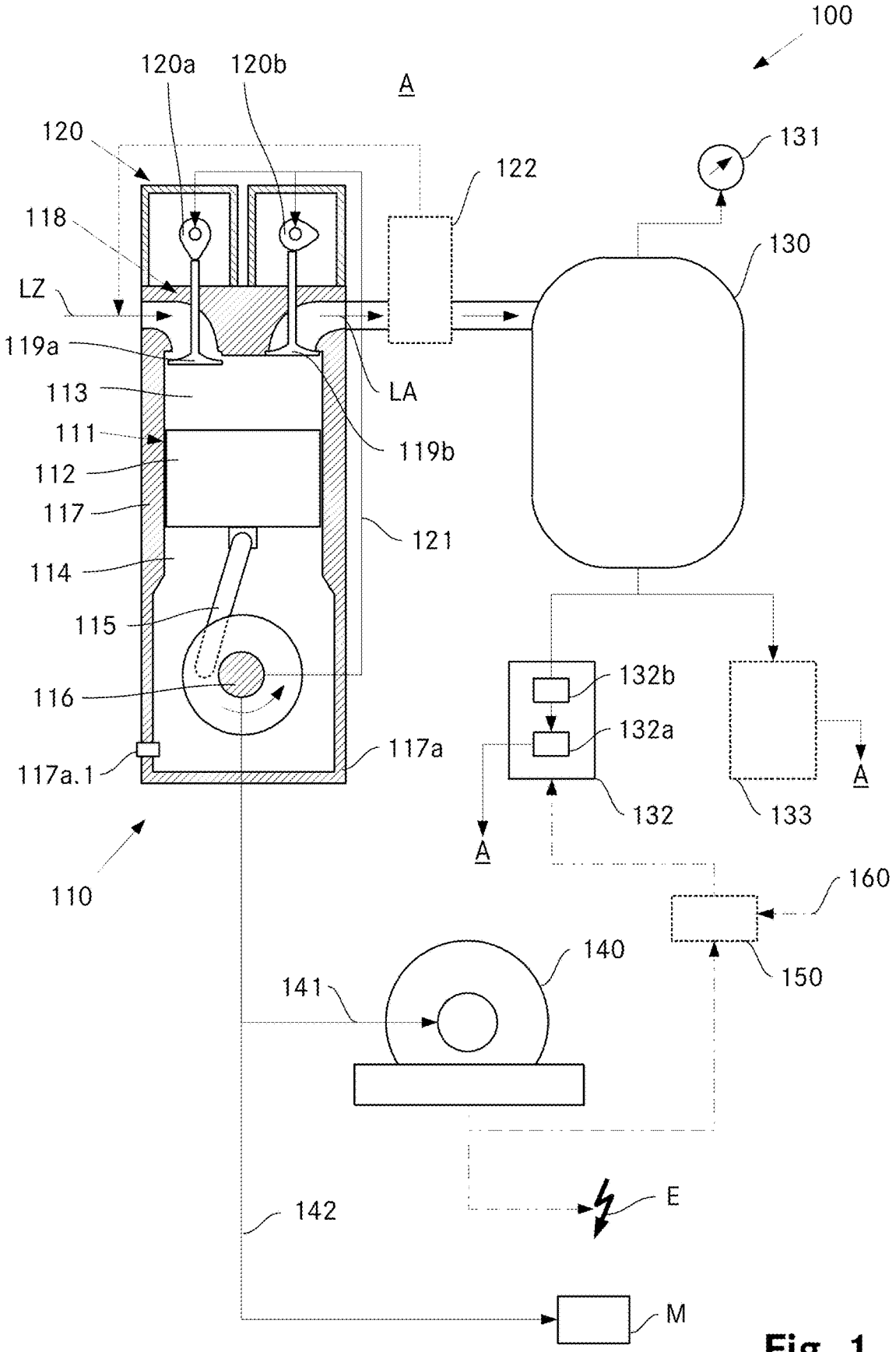
FIG. 1 a schematic representation of an arrangement according to the invention with a reciprocating piston engine which can be driven without combustion and a vacuum chamber in which a reduced air pressure can be generated compared with the atmosphere surrounding the reciprocating piston engine.

FIG. 1 shows a schematic representation of an arrangement 100 according to the invention, comprising a reciprocating piston engine 110 designed for combustion-free operation, which is shown in FIG. 1 in a cross-section perpendicular to the crankshaft and comprises, for example, six cylinders arranged in series. The first cylinder 111 can be seen in FIG. 1, while the other five cylinders are located behind the first cylinder and are not visible in the view of FIG. 1. The entire mechanical structure of the reciprocating piston engine 110 is, for example, made entirely of metal.

The first cylinder 111 of the reciprocating piston engine 110 is arranged in the engine block 117 and closed by a cylinder head 118, a piston 112 being movably mounted in the cylinder 111. On the side of the piston 112 facing away from the cylinder head 118, the piston 112 is coupled to the crankshaft 116 of the reciprocating piston engine 110 via a connecting rod 115. The connecting rod 115 and the crankshaft 116 are integrated in a crankcase 117*a*. The crankcase 117*a* is an integral part of the engine block 117 and also has an open crankcase vent 117*a*.1 in the form of an opening which ensures that, during operation, a substantially constant pressure or the atmospheric pressure surrounding the reciprocating piston engine 110 is always present in a region 114 of the piston 112 facing away from the cylinder head 118.

An inlet valve 119*a* and an outlet valve 119*b* are provided on the cylinder head 118. Via the inlet valve 119*a*, the internal working volume 113 of the cylinder 111 is fluidly connectable to the atmosphere surrounding the reciprocating piston engine 110 (when the valve 119*a* is open as shown in FIG. 1) to supply ambient air LZ to the cylinder or working volume 113 to generate ambient pressure. The outlet valve 119*b* (shown in the closed position in FIG. 1) is fluidly connectable (when the valve 119*a* is open as shown in FIG. 1) to fluidly connect the working chamber 113 of the cylinder 111 to a negative pressure chamber 130 to discharge exhaust air LA to create a negative pressure in the working chamber 113 (for this purpose, the outlet valve 119*b* can be opened and the inlet valve 119*a* can be closed).

Furthermore, the reciprocating piston engine 110 has a valve control 120 in the form of two parallel camshafts120*a*, 120*b*, which are coupled to the crankshaft 116, for example, via a toothed belt 121 (shown symbolically as connecting arrows). The camshafts 120*a*, 120*b*, for example, are coupled to the crankshaft 116 with a gear ratio of 2:1, so that in operation the camshafts 120*a*, 120*b* have half the speed of the crankshaft 116.

The valve control 120 is configured to control the inlet valve 119*a* and the outlet valve 119*b* in operation such that the piston in the cylinder 111 is moved back and forth by alternately applying ambient pressure and negative pressure. Possible actuations to achieve this are described in more detail in connection with FIGS. 2 and 3. The control of the valves of the other cylinders is analogous, with the pistons in cylinders 1 and 6 running in phase, cylinders 2 and 5 running in phase with each other but out of phase with cylinders 1 and 6, while cylinders 3 and 4 run in phase with each other but out of phase with the other cylinders.

In operation, air flowing from outlet valve 119*b* can be used LA to drive an optional turbocharger 122, which compresses ambient air before feeding it through the inlet valve (indicated by a broken connecting line).

The reciprocating piston engine 110 is connected via the outlet valve 119*b* to the vacuum chamber 130, in which there is a pressure of 0.2 bar, for example. The pressure in the vacuum chamber 130 is thus approx. 0.8 bar lower than the ambient pressure or the atmospheric pressure in which the reciprocating piston engine 110 is located. The vacuum in the vacuum chamber 130 can be measured with a pressure gauge 131.

The vacuum chamber 130 is fluidly connected to a vacuum generating device 132. This may be an electrically operated vacuum pump 132*a*, such as a rotary vane pump, which is operated in combination with an electrically operated vacuum booster 132*b* connected between the vacuum chamber 130 and the electrically operated vacuum pump. The air delivered from the vacuum chamber 130 is discharged into the atmosphere A. Additionally or alternatively, there may be a second vacuum generating device 133 in the form of a venturi tube which is mounted, for example, in a watercourse, and which also evacuates air from the vacuum chamber 130 and discharges it into the atmosphere.

The electrically powered vacuum pump 132*a* and vacuum booster 132*b* may be supplied with electrical power (shown as a dashed line) via an optional power storage device 150, e.g., an accumulator, which is charged by an external power source 160, e.g., a solar panel and/or the electrical grid.

During operation, the pressure in the vacuum chamber is kept in the range of, for example, 0.1-0.3 bar.

The crankshaft 116 of the reciprocating piston engine 110 is further coupled to an electric generator 140 via a gearbox 141 (indicated by a connecting arrow in FIG. 1), so that usable electric energy E can be generated by the work of the reciprocating piston engine 110.

It is also possible to supply a portion of the energy generated in the generator to the electricity storage 150. For example, electrical energy generated using the venturi tube can be temporarily stored in the form of electricity in the current storage150 and used at a later time to operate the vacuum motor 110.

The crankshaft 116 can optionally be coupled to a mechanical machine M via a second gearbox 142 to directly drive the mechanical machine M.

Figure 2:
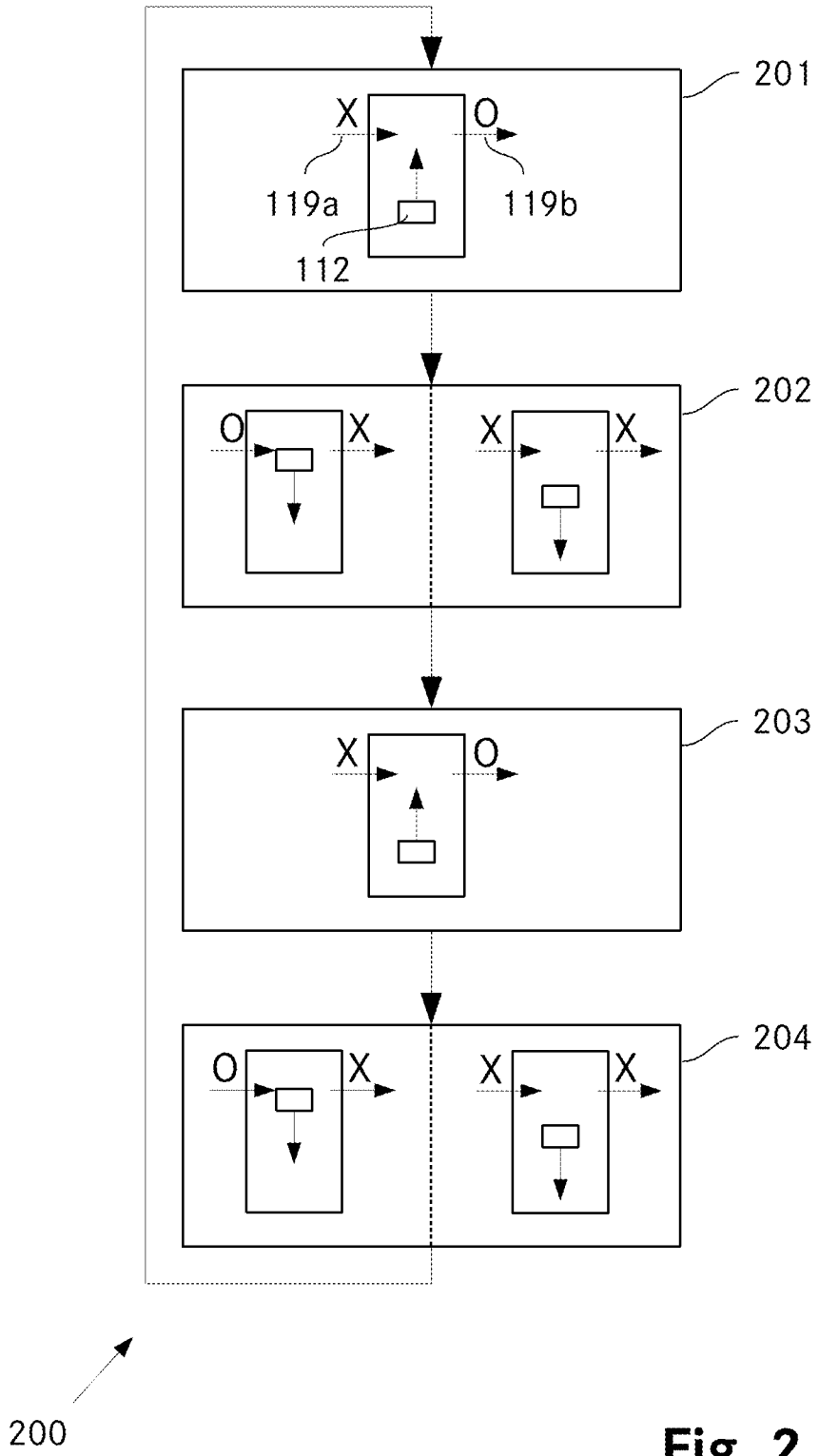
FIG. 2 a first way of controlling the valves of the reciprocating piston engine of FIG. 1.

FIG. 2 shows a first way of controlling the valves of the first cylinder 111 of the reciprocating piston engine 110. The valves of the other cylinders are controlled in a similar way, but in such a way that the phase relationships described above are maintained. Specifically, the inlet valve 119*a* (left horizontal arrow) and the outlet valve 119*b* (right horizontal arrow) are controlled as described below. In each case, the closed position is indicated as ("X") and the open position is indicated as "O".

In a first stroke 201, in which the piston 112 moves towards the cylinder head (indicated by the arrow pointing upwards), the outlet valve 119*b* is open (O) and the inlet valve 119*a* is closed (X), so that the piston is pulled towards the cylinder head by the negative pressure.

In a subsequent second stroke 202, in which the piston 112 moves away from the cylinder head (indicated by the arrow pointing downwards), in a first time period (left side) the outlet valve is closed (X) and the inlet valve is open (O) and in a subsequent second time period (right side) both valves are closed (X/X), so that in the second time period the piston moving away from the cylinder head generates a vacuum in the working chamber.

In the following stroke 203, the valves are switched as in the first stroke 201, while in the following stroke 204, the valves are switched as in the second stroke. The cycle then starts again.

In the cycle shown, each of the strokes corresponds to a half revolution of the crankshaft 116, so that the crankshaft has executed exactly two revolutions after one cycle. The camshafts 120*a*, 120*b* rotate exactly once in the process.

The embodiment shown is to be understood as an example only, which can be modified as desired within the scope of the invention.

For example, it is possible to provide a radial engine or a V-engine instead of an in-line engine 110. Also, the engine can have more or less than six cylinders.

Likewise, the valve control can be designed differently. For example, the closing and opening times can be adapted or the control can be performed by a single camshaft.

It is also possible to manufacture individual components or the entire mechanical structure of the reciprocating piston engine 110 from a material other than metal, e.g., plastic, ceramic, and/or a composite material.

The power storage 150 can also be omitted. In this case, the electrically operated vacuum pump 132*a* and the vacuum booster 132*b* can be connected directly to the external power source 160, for example.

In summary, a particularly advantageous arrangement comprising a reciprocating piston engine and a vacuum chamber has been provided, which can be used for the economic production, conversion, storage and utilization of energy in different forms.

The invention claimed is:

1. An arrangement comprising a reciprocating piston engine, which is configured for combustion-free operation, and a vacuum chamber, in which a reduced air pressure can be generated relative to the atmosphere (A) surrounding the reciprocating piston engine, wherein:

a) the reciprocating piston engine has at least one cylinder which is closed by a cylinder head and in which a piston can be moved, the piston coupled to a crankshaft of the reciprocating piston engine via a connecting rod on a side facing away from the cylinder head, wherein the connecting rod and the crankshaft are integrated in a crankcase of the reciprocating piston engine;

b) the at least one cylinder on the cylinder head has at least one inlet valve and at least one outlet valve, the vacuum chamber being connectable via the outlet valve to a working chamber of the at least one cylinder in a fluid-conducting manner, to generate a negative pressure in the working chamber, and the working chamber being fluid-conductively connectable to the atmosphere (A) surrounding the reciprocating piston engine via the inlet valve to generate ambient pressure in the working chamber;

c) wherein a valve control is provided which controls the inlet valve and the outlet valve in operation such that the piston in the at least one cylinder is moved back and forth by alternately applying ambient pressure and negative pressure;

d) and the reciprocating piston engine is configured in such a way that during operation there is always a substantially constant pressure, in a region of the piston facing away from the cylinder head, and wherein the reciprocating piston engine has a turbocharger, the turbocharger configured to be driven by the air flowing out of the outlet valve and to compress the ambient air supplied via the inlet valve.

2. The arrangement according to claim 1, wherein the reciprocating piston engine has two cylinders, or four, or six, or eight, or ten or twelve cylinders.

3. The arrangement according to claim 1, wherein the valve control is realized via at least one camshaft coupled to the crankshaft.

4. The arrangement according to claim 3, wherein the at least one camshaft is coupled to the crankshaft with a gear ratio of 2:1, so that in operation the at least one camshaft has half the speed of the crankshaft.

5. The arrangement according to claim 1, wherein the valve control is configured such that:

in a first stroke, in which the piston moves towards the cylinder head, the outlet valve is open and the inlet valve is closed so that the piston is pulled towards the cylinder head by the negative pressure; and in a subsequent second stroke, in which the piston moves away from the cylinder head, in a first time period the outlet valve is closed and the inlet valve is open and in a subsequent second time period the inlet and outlet valves are closed, so that in the second time period the piston moving away from the cylinder head generates a negative pressure in the working chamber.

6. The arrangement according to claim 1, wherein an engine block, the piston, the connecting rod, the crankshaft, the at least one camshaft and/or the crankcase of the reciprocating piston engine comprises plastic, ceramic and/or a composite material.

7. The arrangement according to claim 1, wherein the vacuum chamber is connected in a fluid-conducting manner to a vacuum-generating device so that the vacuum chamber can be or is evacuated by the vacuum-generating device.

8. The arrangement according to claim 7, wherein the vacuum generating means includes a venturi tube.

9. The arrangement according to claim 7, wherein the vacuum generating device includes an electrically operated vacuum pump.

10. The arrangement according to claim 1, wherein the crankshaft of the reciprocating piston engine is coupled to an electric generator so that electric current (E) can be or is generated by the work of the reciprocating piston engine.

11. A method of operating an arrangement according to claim 1, wherein negative pressure and ambient pressure are alternately applied in the working chamber via the inlet valve and the outlet valve, so that the piston is moved back and forth in the at least one cylinder.

12. The method according to claim 11, wherein the pressure in the vacuum chamber is at least 0.2 bar lower than the atmospheric pressure (A) surrounding the reciprocating engine.

13. The arrangement according to claim 9, wherein the vacuum generating device further comprises a vacuum booster connected between the vacuum chamber and the electrically operated vacuum pump.

14. The arrangement according to claim 9, wherein the electrically operated vacuum pump comprises a rotary vane pump.

15. The arrangement according to claim 1, wherein the reciprocating piston engine is configured in such a way that during operation there is always an atmospheric pressure (A) surrounding the reciprocating piston engine in a region of the piston facing away from the cylinder head.

16. An arrangement comprising a reciprocating piston engine, which is configured for combustion-free operation, and a vacuum chamber, in which a reduced air pressure can be generated relative to the atmosphere (A) surrounding the reciprocating piston engine, wherein:

a) the reciprocating piston engine has at least one cylinder which is closed by a cylinder head and in which a piston can be moved, the piston coupled to a crankshaft of the reciprocating piston engine via a connecting rod on a side facing away from the cylinder head, wherein the connecting rod and the crankshaft are integrated in a crankcase of the reciprocating piston engine;

b) the at least one cylinder on the cylinder head has at least one inlet valve and at least one outlet valve, the vacuum chamber being connectable via the outlet valve to a working chamber of the at least one cylinder in a fluid-conducting manner, to generate a negative pressure in the working chamber, and the working chamber being fluid-conductively connectable to the atmosphere (A) surrounding the reciprocating piston engine via the inlet valve to generate ambient pressure in the working chamber;

c) wherein a valve control is provided which controls the inlet valve and the outlet valve in operation such that the piston in the at least one cylinder is moved back and forth by alternately applying ambient pressure and negative pressure;

d) and the reciprocating piston engine is configured in such a way that during operation there is always a substantially constant pressure, in a region of the piston facing away from the cylinder head, wherein the vacuum generating device includes an electrically operated vacuum pump, and wherein the vacuum generating device further comprises a vacuum booster connected between the vacuum chamber and the electrically operated vacuum pump.

* * * * *